United States Patent [19]

Laramore

[11] Patent Number: 4,512,131

[45] Date of Patent: Apr. 23, 1985

[54] PLANK-TYPE BUILDING SYSTEM

[76] Inventor: Larry W. Laramore, 22526 108th SE. Ave., Kent, Wash. 98031

[21] Appl. No.: 538,133

[22] Filed: Oct. 3, 1983

[51] Int. Cl.[3] ..... E04B 1/40

[52] U.S. Cl. ..... 52/586; 52/595

[58] Field of Search ..... 52/582, 585, 586, 595

[56] References Cited

U.S. PATENT DOCUMENTS

| | | | |
|---|---|---|---|
| 662,376 | 11/1900 | Goehst . | |
| 668,720 | 2/1901 | Siegmund . | |
| 2,619,686 | 12/1952 | Dombrowski . | |
| 2,650,395 | 9/1953 | De Anguera . | |
| 3,085,301 | 4/1963 | Nuorivaara . | |
| 3,230,681 | 1/1966 | Allen et al. . | |
| 3,276,797 | 10/1966 | Humes, Jr. . | |
| 3,299,270 | 1/1967 | D'Anella | 52/595 X |
| 3,350,828 | 11/1967 | Russell . | |
| 3,603,053 | 9/1971 | Van Loghem et al. . | |
| 3,998,024 | 12/1976 | Frandsen | 52/595 |
| 4,169,688 | 10/1979 | Toshio . | |
| 4,170,859 | 10/1979 | Counihan . | |

FOREIGN PATENT DOCUMENTS

| | | | |
|---|---|---|---|
| 2008488 | 3/1972 | Fed. Rep. of Germany | 52/586 |
| 2714965 | 10/1978 | Fed. Rep. of Germany | 52/586 |
| 2903844 | 8/1980 | Fed. Rep. of Germany | 52/586 |
| 1010738 | 3/1952 | France | 52/586 |
| 60333 | 4/1954 | France | 52/586 |
| 207081 | 9/1966 | Sweden | 52/586 |

*Primary Examiner*—J. Karl Bell

*Attorney, Agent, or Firm*—Christensen, O'Connor, Johnson & Kindness

[57] ABSTRACT

A plank-type building system uses longitudinal splines and transverse tie bars to provide a solid wood wall building structure having increased structural rigidity. Planks having a longitudinal groove extending along each side surface of a plank are used to form the floor, walls, and roof of a building. The planks are connected together by a separate spline that is inserted into the grooves of adjacent planks. A transverse slot is formed on a main surface of each plank to receive a tie bar that prevents relative displacement of adjacent planks. The tie bar also prevents insect and element infiltration through gaps formed between adjacent planks.

14 Claims, 11 Drawing Figures

PLANK-TYPE BUILDING SYSTEM

BACKGROUND

The present invention relates to a building construction system and, more particularly, to a plank, post, and beam-type building system.

Plank, post and beam building systems have been in existence for many years. For example, the "log" home uses logs both vertically and horizontally to form wall and floor structures. Current building systems utilizing solid wood wall (hereinafter solid wall) construction techniques employ milled timbers with vertical, horizontal, or angular positioning for forming walls, floors and a roof. In all types of solid wood wall building construction, wood shrinkage causes a major design problem.

Wood shrinkage in a solid wall building allows the infiltration of elements such as wind, rain, heat, and cold, as well as infiltration of insects and vermin. Wood shrinkage also causes the structure to lose strength by allowing displacement of adjacent wood planks due to wind loading, earthquake, or other external forces. This displacement includes longitudinal or shear displacement of adjacent planks, referred to in the art as "racking."

To compensate for the loss of strength in a building due to wood shrinkage, additional structural members must often be added to the structure, which increases the costs and time of construction.

A partial cross section of the roof, wall, and floor of a typical, prior art solid wall building structure 10 is illustrated in FIG. 1. Horizontally laid floor planks 12 are nailed to a horizontally oriented floor plate 14 that is used to support the floor. The lower end of vertically oriented wall planks 16 are fastened to the outer surface of floor plate 14 and the upper end of the wall planks is fastened to the outer surface of a perimeter beam 20. The perimeter beam 20 is used to support a roof 22. A wedge 24 is placed atop the perimeter beam 20 to provide the correct angle or pitch of the roof.

As illustrated in FIGS. 2 and 3, prior art planks 16 used in the construction of solid wall houses use a tongue and groove configuration to prevent displacement of adjoining planks. It is to be noted that the tongue and groove structure does not prevent racking of adjacent planks other than by the frictional resistance between the surfaces of the tongue and groove. A prior art plank 16 includes a tongue 26 that extends outwardly from one side edge of the plank and a complementary shaped groove 28 formed in the opposite side surface of the plank to receive the tongue 26 from an abutting plank.

The problem caused by wood shrinkage is illustrated by comparing FIGS. 2 and 3. As shown in FIG. 2, when there is no wood shrinkage, the tongue 26 fits snugly within groove 28, thereby preventing displacement between adjoining planks 16. When planks 16 shrink, as shown in FIG. 3, gaps or spaces 32 appear between the tongue 26 and groove 28. These gaps 32 allow adjoining planks to move relative to one another, thereby reducing the strength of the building structure 10.

As stated above, the tongue and groove structure does not substantially prevent racking of adjoining planks. An attempt to avoid racking in prior art buildings is made by nailing the planks to underlying wood structure, such as the floor plate 14 or perimeter beam 20. However, due to the expansion and contraction of the wood planks from wood shrinkage and the resulting loosening of the nails, nailing the planks to underlying wood structures does not provide a completely satisfactory method of preventing longitudinal displacement.

Another commonly used feature in solid wall building construction is illustrated in FIGS. 2 and 3. The side surfaces of the wood planks 16 are chamfered for aesthetic purposes. The chamfers improve the appearance of the solid wall structures, however, a drawback of the V-shaped grooves 34 formed by the chamfers is that they provide entry points for the infiltration of elements and various insects and animals.

Accordingly, it is an object of the present invention to provide a plank-type building system that provides adequate strength for a solid wall structure without the use of additional strengthening elements.

It is another object of the present invention to provide a plank-type building system that prevents the infiltration of elements and insects while also accommodating the problem of wood shrinkage.

SUMMARY OF THE INVENTION

The present invention satisfies the needs not met by the prior art by providing a plank-type building system that incorporates features for increasing the strength of a solid wall structure and for preventing element and insect infiltration.

The present invention comprises a plank-type building system including planks having two opposing, major surfaces. Side surfaces that are spaced away from one another join the major surfaces. A longitudinal groove extends along each side surface of a plank to receive a spline that is configured to fit within the longitudinal groove. A transverse slot is formed in one of the major surfaces and intersects the longitudinal grooves. When the planks are assembled in side-by-side abutting relationship, a connecting means engages the transverse slots.

In a preferred embodiment of the invention, the grooves have a stepped configuration when viewed in a transverse section with a first recessed surface spaced inwardly from the side surface and a second recessed surface spaced further inwardly from the side surface. The longitudinal grooves on each side of the plank are mirror images of one another. Each spline has a stepped configuration when viewed in a transverse section that is complementary to the stepped configuration of the longitudinal grooves.

In the preferred embodiment, a second transverse slot is formed in the same major surface of the plank as the first transverse slot with the first and second transverse slots preferably located adjacent each end of the plank. The connecting means used for inserting into the transverse slots includes a rectangularly shaped tie bar.

A wall, floor, or roof of a building structure is formed by placing planks in a side-by-side arrangement. A spline is inserted into the longitudinal grooves of the adjoining sides of adjacent planks to connect the planks. The splines and longitudinal grooves provide structural rigidity for adjoining planks by preventing displacement between the planks. It is preferred that the major surface of the plank that is closest to the first recessed surface of the longitudinal groove be oriented toward the weather side of the building structure. This arrangement orients the stepped configuration of the spline toward the outer surface of the building and presents a longer path for infiltration.

Preferably, the transverse slots formed in the planks are oriented toward the inside of the building structure and proximate an underlying member of the building system such as a floor plate or a perimeter beam. Tie bars are inserted into the transverse slots and prevent longitudinal racking of adjacent planks. By locating the transverse slots adjacent the floor plate and perimeter beam, and by having the slots intersect the longitudinal grooves in the planks, infiltration that would occur through the gaps formed between adjoining planks is prevented by the presence of the tie bars.

BRIEF DESCRIPTION OF THE DRAWINGS

Other features and advantages of the present invention will become apparent to one skilled in the art after a reading of the following description taken together with the accompanying drawing in which.

DETAILED DESCRIPTION

Figure 4:
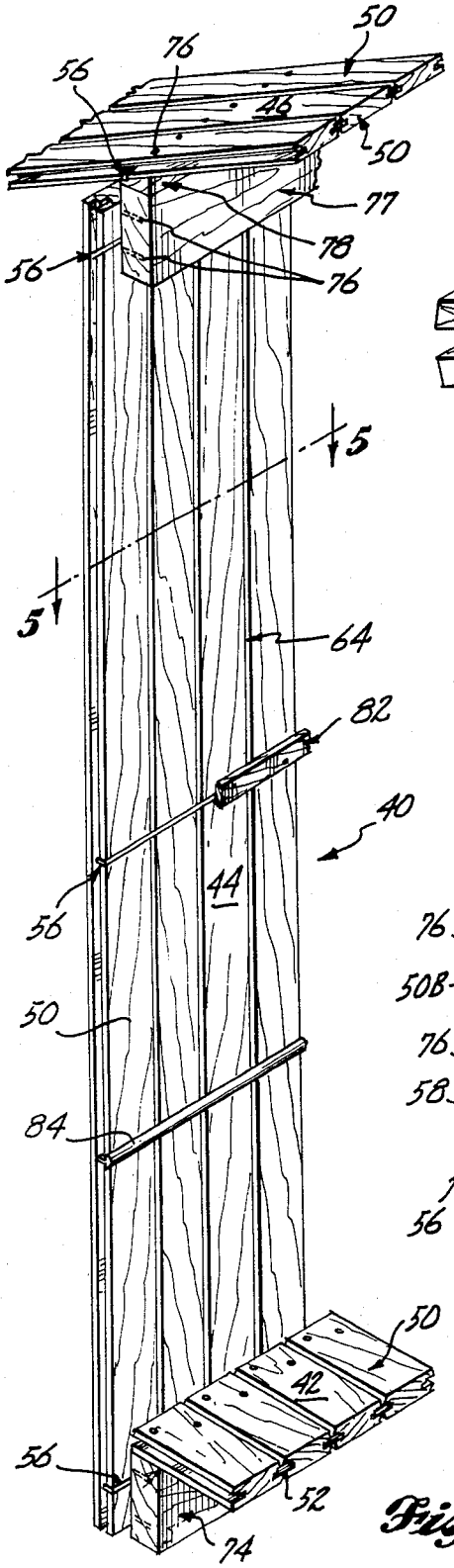
FIG. 4 is an isometric view of a portion of a building structure using elements of the present invention.

Referring first to FIG. 4, a partial section of a building 40 constructed in accordance with the present invention is shown. The building includes a floor 42, a wall 44, and a roof 46 made from planks 50 positioned in an abutting, side-by-side arrangement. Adjoining planks 50 are held together by longitudinally oriented splines 52 that fit within grooves formed in the side surfaces of the planks. Longitudinal racking of adjacent planks 50 is prevented by the use of transversely oriented tie bars 56 located within slots formed transversely in the inner, major surfaces of the planks. Due to the identical cross-sectional configuration of the planks 50 used in the floor 42, wall 44, and roof 46, the same reference numeral will be used to indicate the planks used throughout the building 40. The only variation between planks 50 used throughout a building 40 will be differences in length.

Figure 1:
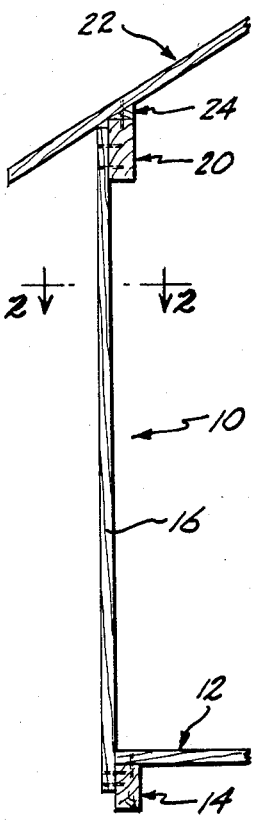
Fig. 1. (PRIOR ART)
FIG. 1 is a cross-sectional, side elevation view of a building structure using a prior art building system.
Figure 2:
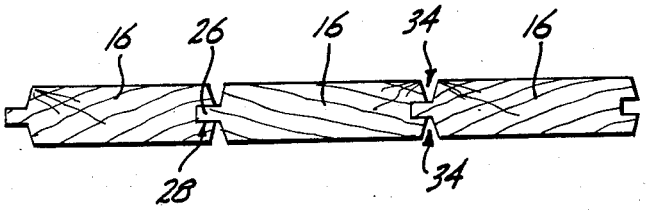
Fig. 2. (PRIOR ART)
FIG. 2 is a cross-sectional view of the wall of the building structure of FIG. 1 taken along section line 2—2.
Figure 3:
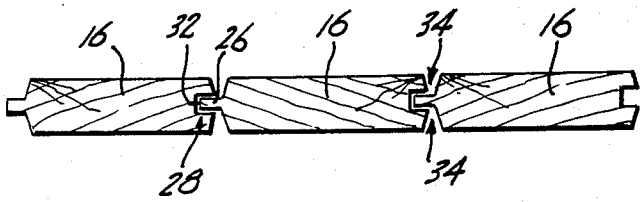
Fig. 3. (PRIOR ART)
FIG. 3 is the same cross-sectional view as in FIG. 2, wherein the wooden planks forming the wall have been subjected to shrinkage.
Figure 5:
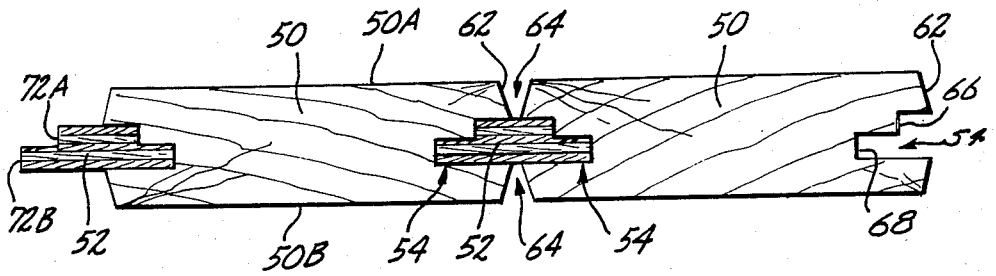
FIG. 5 is a cross-sectional view of the wall of the building structure of FIG. 4 taken along section line 5—5.

Turning now to the more detailed structural aspects of the invention, the relationship of the planks 50 and splines 52 in the wall 44 as shown in FIG. 5 is also typical of the construction technique used for the floor 42 and roof 46. Adjoining planks 50 are connected by a spline 52 that is inserted into grooves 54 formed in each side surface 62 of the planks. The side surfaces 62 of the planks shown in FIG. 5 and the following FIGURES are chamfered, i.e., inclined from a plane normal to opposing major surfaces 50A, 50B of planks 50, so as to define longitudinal V-grooves 64 between each pair of adjacent planks. The side surface grooves 54 have a stepped configuration when viewed in a transverse section. A first recessed surface 66 is spaced inwardly from the side surface 62 and extends substantially normal to major surfaces 50A, 50B. A second recessed surface 68 is oriented substantially parallel to and spaced inwardly from the first recessed surface 66. The groove 54 on one side of a plank 50 is a mirror image of the groove on the other side when viewed about a longitudinal plane bisecting the width of the plank.

The splines 52 have a width equal to twice the distance from side surface 62 to the second recessed surface 68. This width allows the spline 52 to extend between adjoining grooves 54 of planks 50 that are adjacent one another. The side surfaces of the splines 52 have a complementary shaped stepped configuration that allows the side surfaces 72A, 72B of the spline to abut the first and second recessed surfaces 66 and 68. Thus, when two planks 50 are adjacent one another with a spline 52 inserted in adjoining grooves 54, displacement of the planks is prevented.

Figure 6:
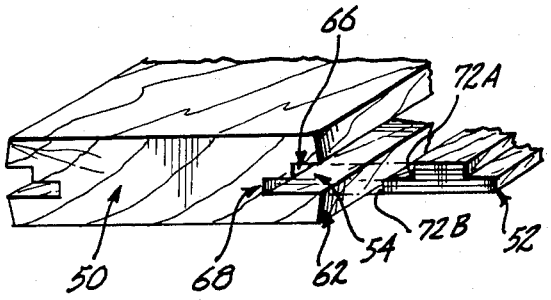
FIG. 6 is an isometric view of an end of a plank used in the building system of the present invention showing the relationship between a spline and a longitudinal groove in the plank.

As shown in FIG. 6, when a portion of building 40 is being constructed using the present building system, a spline 52 is inserted laterally into the groove 54 that is formed in the sidewall 62 of plank 50. The spline 52 can be tapped into place so that the side surfaces 72A, 72B of the spline abut the first and second recessed surfaces 66 and 68 of the groove 54. As an additional measure to prevent the infiltration of elements past the spline 52, some type of flexible caulking material, such as a silicone sealant, can be applied to the groove 54 prior to the insertion of the spline.

The greater depth of insertion permitted by the use of individual splines 52 placed between adjoining planks 50 provides a stronger structure than can be obtained using the tongue-and-groove method of prior art building systems. Additionally, the use of longitudinal grooves 54 in both side surfaces of a plank 50 avoids wastage of material when compared to a conventional tongue-and-groove system. Use of individual splines 52 in the present invention also permits the use of materials having greater stability from the standpoint of shrinkage. For example, laminated plywood or injection-molded plastic splines may be used in the present building system.

Figure 7:
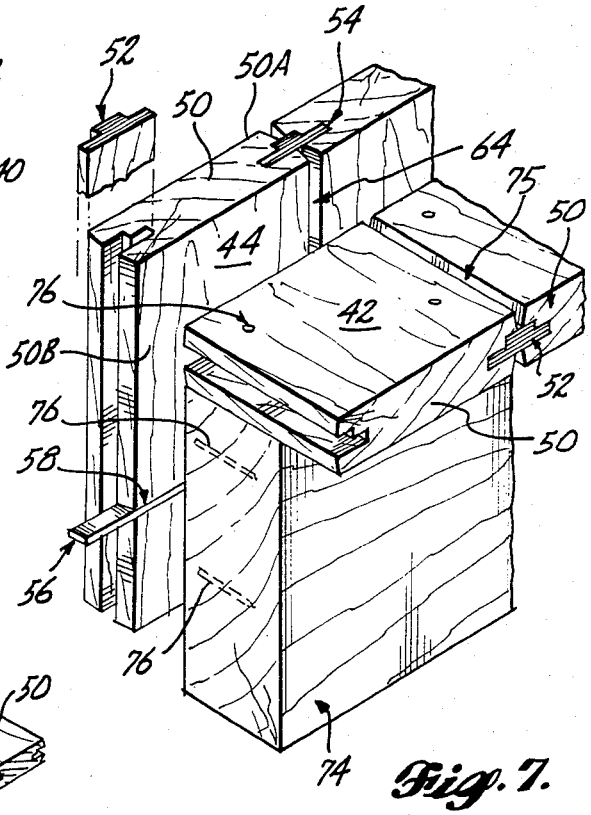
FIG. 7 is an enlarged view of the junction of the wall and the floor of the building structure shown in FIG. 4.

Referring now to FIG. 7, a more detailed description of the junction of floor 42 with wall 44 of building 40 will be presented. As shown in the FIGURE, a floor plate 74 forms a primary member to which planks 50 forming the floor 42 are attached. The floor plate 74 is a standard milled timber having a rectangular configuration that is set on edge. Planks 50 forming the floor 42 are attached to the upper surface of the floor plate 74 with conventional fasteners, e.g., nails 76. The planks 50 forming the floor 42 are laid in a side-by-side arrangement with the sidewalls of adjoining planks abutting one another. As shown in FIGS. 4 and 7, splines 52 are inserted within the grooves 54 of adjoining planks 50.

Still referring to FIGS. 4 and 7, planks 50 are also used to form the wall 44 of the building 40. The planks 59 of wall 44 are oriented vertically with the lower end of the planks forming the wall 44 being attached to the outer surface of floor plate 74. As with floor 42, the planks 50 forming the wall 44 are arranged in a side-by-side manner with adjoining planks 50 being joined by a spline 52 inserted into grooves 54. The planks 50 of wall 44 are preferably oriented to have the major surface 50A of the plank closest to the first recessed surface 66 of groove 54 facing the outside or weather side of the wall 44. This arrangement appears to provide the greatest resistance to infiltration of elements past the spline 52, though the advantages of the building system will also be realized if the planks are installed in the reversed orientation.

As best shown in FIG. 7, the inner major surface 50B of each of the planks 50 forming the wall 44 is formed with a transverse slot 58 at the lower end of wall 44. The slot 58 is positioned to abut the outer surface of floor plate 74. A continuous tie bar 56 is inserted into the slots 58 to prevent longitudinal racking of the planks 50. Preferably, the slot 58 is oriented perpendicularly to the longitudinal axis of the plank 50, and is formed to intersect the surface of the groove 54 that is closest to the floor plate 74. This arrangement permits the tie bar 56 to completely obstruct the V-groove 64 of adjoining planks 50 and thereby block a passage for the infiltration of the elements and of insects and vermin. Once a wall 44 is formed by arranging the planks 50 in the manner described above, the lower end of the wall is fastened to the floor plate 74 by nails 76. Preferably, nails 76 are inserted above and below the tie bar 56.

Figure 8:
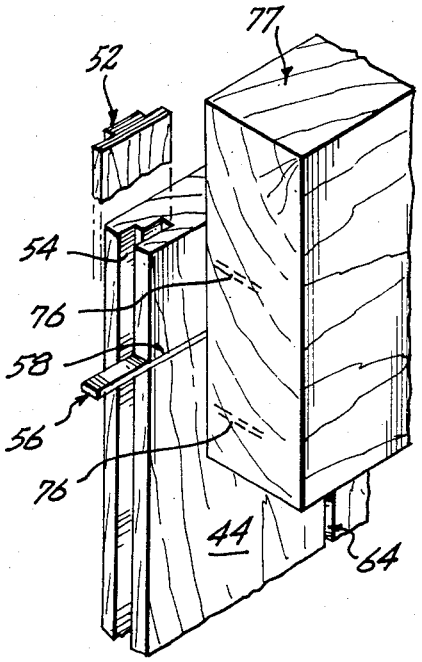
FIG. 8 is an enlarged isometric view of the junction between the wall and the perimeter beam of the building structure shown in FIG. 4.

Referring now to FIGS. 4 and 8, the upper end of the planks 50 forming the wall 44 is also formed with a slot 58 that is oriented transversely to the length of the planks. The slot 58 is positioned to abut the outer surface of perimeter beam 77 located at the upper end of the wall 44. The configuration of this slot 58 is substantially identical to the slot 58 formed at the lower end of the wall, in that the bottom of the slot intersects the groove 54 formed in each side surface of a plank 50. Another tie bar 56 is inserted into the slots 58 across all of the planks 50 forming the wall 44. The function of this upper tie bar 56 is also to prevent longitudinal racking and to prevent infiltration through the V-groove 64 of adjoining planks 50.

The upper end of the wall 44 is attached to the perimeter beam 77 that extends the length of the wall 44 by nails 76 that preferably are inserted above and below the tie bar 56. The perimeter beam 77 prevents the lateral displacement of the planks 50 forming the wall 44 and also provides an attachment point for the roof 46. The perimeter beam 77 is constructed from a rectangularly shaped milled timber that is set on edge.

Figure 9:
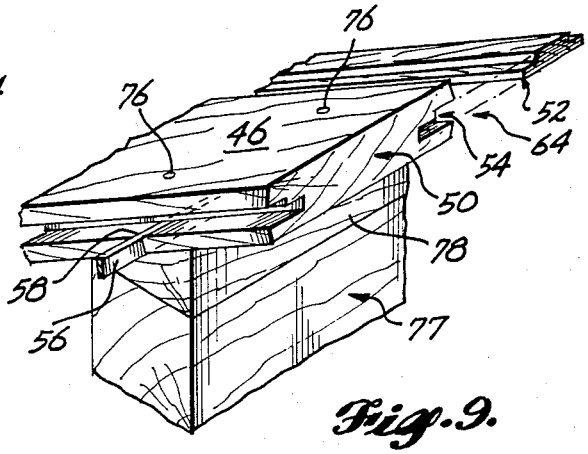
FIG. 9 is an enlarged isometric view of the junction between the roof and the perimeter beam of the building structure shown in FIG. 4.

Referring now to FIGS. 4 and 9, a wedge 78 is placed on the upper surface of the perimeter beam 77 to provide the correct angle or pitch for the roof 46. The roof 46 is formed by arranging the planks 50 in a side-by-side arrangement as was done with the floor 42 and the wall 44. Once again, splines 52 are placed into the grooves 54 formed in the side surfaces 62 of planks 50 to connect the adjoining planks.

As best illustrated in FIG. 9, a slot 58 extends transversely along the lower major surface of each of the planks 50 forming the roof 46. The slots 58 are positioned to abut the upper surface of the wedge 78. A tie bar 56 is inserted into the slots 58 to prevent longitudinal racking of the planks 50 forming the roof 46 and to prevent infiltration through V-groove 64. The planks 50 forming the roof 46 are fastened to the wedge 78 and perimeter beam 77 by conventional fastening means, such as nails 76.

Figure 10:
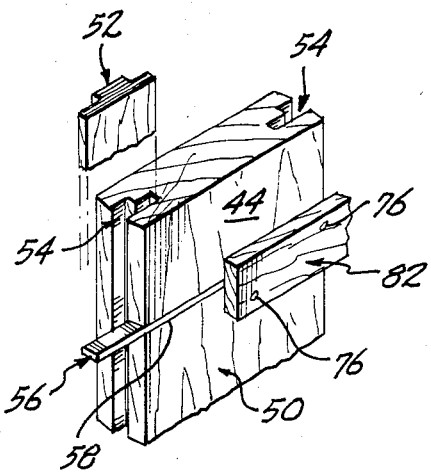
FIG. 10 is an enlarged isometric view of a plank, tie bar, and spline of the building system of the present invention showing the relationship between the tie bar and the spline.

There may be situations in which it is necessary to provide greater resistance to longitudinal racking of the planks 50 forming the wall 44 of a building structure than can be provided by a tie bar 56 at the upper and lower ends of the wall. In such a situation, additional slots 58 and tie bars 56 can be placed at intermediate heights in the wall as illustrated in FIG. 4. When a tie bar 56 and a slot 58 are located on an intermediate, exposed surface of the wall 44, a molding 82 can be used to cover the tie bar and slot for aesthetic purposes. As shown in FIG. 10, the molding 82 can be made from a rectangularly shaped piece of wood or other material.

Figure 11:
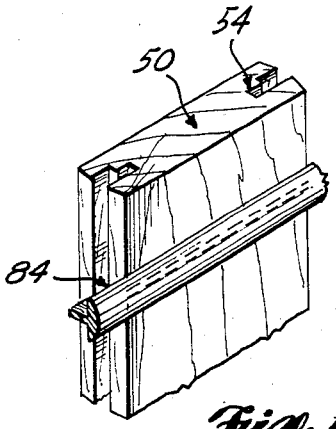
FIG. 11 is an enlarged isometric view of a plank of the building system of the present invention using an alternate embodiment of a tie bar.

As an alternative embodiment to a separate tie bar 56 and molding 82, an integrated tie bar 84 having a "T" shaped configuration when viewed in a transverse section, as illustrated in FIG. 11, can be used in the intermediately placed slot 58. The integrated tie bar may be formed from a metal or an extruded, rigid plastic material having sufficient strength to withstand longitudinal racking of the planks 50.

As can be seen by the description of the present invention, a building system having inherent structural rigidity due to the splines 52 used to connect and prevent displacement of adjoining planks 50, and the tie bars 56 that prevent longitudinal racking of the planks has been disclosed. The arrangement of the tie bars in the building system is unique in that the tie bars are also used to prevent infiltration into the building.

The present invention has been described in relation to a preferred embodiment and variations upon that embodiment. One of ordinary skill, after reading the foregoing specification, will be able to effect various changes, alterations, and substitutions of equivalents without departing from the broad concepts disclosed. It is therefore intended that the scope of Letters Patent granted hereon be limited only by the definitions contained in the appended claims and equivalents thereof.

The embodiments of the invention in which an exclusive property or privilege is claimed are defined as follows:

1. A plank-type building system, comprising:

at least two planks, each plank having first and second opposing major surfaces, first and second side surfaces joining said major surfaces, and first and second end surfaces joining said major and said side surfaces, said first and said second side surfaces each having a longitudinal groove formed therein, said second major surface having a slot oriented transversely to said second major surface, said slot extending to said first and said second side surfaces and having a depth sufficient to intersect said longitudinal grooves therein, said slot being positioned proximate one of said first and said second end surfaces for abutment with an underlying member of the building system;

a spline for engaging said longitudinal grooves of said planks when said planks are arranged with said first side surface of one plank in abutment with said second side surface of the other plank; and, connecting means for engaging said slots of said planks and preventing longitudinal displacement thereof.

2. The building system of claim 1, wherein said second major surface of each plank has a second slot extending to said first and second side surfaces and having a depth sufficient to intersect said longitudinal grooves therein, said second slot being positioned proximate to the other of said first and second end surfaces for abutment with a second underlying member of the building system, and further comprising a second connecting means for engaging said second slots of said planks and preventing longitudinal displacement thereof.

3. The building system of claim 1, wherein said first and second side surfaces of each plank are chamfered from each of said first and second major surfaces to define first and second V-grooves between said planks, and wherein said connecting means blocks said second V-groove when engaged in said slot and in abutment with the underlying member of the building structure.

4. The building system of claim 1, wherein each longitudinal groove in said first side surface has a stepped configuration when viewed in a transverse section defined by a first recessed surface extending substantially normal to said first and second major surfaces and spaced inwardly from said first side surface and by a second recessed surface extending substantially parallel to said first recessed surface and spaced further inwardly from said first side surface, wherein said longitudinal groove in said second side surface has a stepped configuration that is the mirror image of the stepped configuration of said longitudinal groove in said first side surface, and, wherein said spline has a stepped configuration when viewed in a transverse section that is complementary to the stepped configurations of said longitudinal grooves in said first and second side surfaces.

5. The building system of claim 1, wherein said slot has a substantially rectangular configuration when viewed in a transverse section, the depth of such slot being greater than its width, and where said connecting means comprises an elongated tie bar having a rectangular configuration when viewed in a transverse section that is complementary to that of said slot.

6. The building system of claim 1, wherein said second major surface of each plank has a second slot extending to said first and second side surfaces and having a depth sufficient to intersect said longitudinal grooves therein, said second slot being positioned intermediate said first and said second end surfaces, and further comprising a second connecting means for engaging said second slots of said planks and preventing longitudinal displacement thereof.

7. The building system of claim 6, wherein said second slot has a substantially rectangular configuration when viewed in the transverse section, the depth of said second slot being greater than its width, and wherein said second connecting means comprises an elongated tie bar having a rectangular configuration when viewed in a transverse section that is complementary to that of said second slot.

8. The building system of claim 7, further comprising elongated means adapted to be secured to said second major surface of said planks and to cover said tie bar.

9. The building system of claim 7, wherein said tie bar has a T-shaped configuration when viewed in a transverse section, said T-shaped configuration consisting of a rectangular portion within said slot and a second portion substantially normal to said rectangular portion for abutting said second major surface of said planks.

10. A plank-type building system, comprising:

at least two planks, each plank having first and second opposing major surfaces, first and second side surfaces joining said major surfaces, and first and second end surfaces joining said major and side surfaces, said first and second side surfaces each having a longitudinal groove formed therein, said longitudinal groove in said first side surface having a stepped configuration when viewed in a transverse section defined by a first recessed surface extending substantially normal to said first and second major surfaces and spaced inwardly from said first side surface and by a second recessed surface extending substantially parallel to said first recessed surface and spaced further inwardly from said first side surface, said longitudinal groove in said second side surface having a stepped configuration that is the mirror image of the stepped configuration of said longitudinal groove and said first side surface; and, a spline for engaging said longitudinal grooves of said planks when said planks are arranged with said first side surface of one plank in abutment with said second side surface of the other plank, said spline having a stepped configuration when viewed in a transverse section that is complementary to the stepped configurations of said longitudinal grooves in said first and second side surfaces.

11. The building system of claim 10, wherein each said longitudinal groove extends from said first end surface to said second end surface.

12. The building system of claim 11, wherein said spline has a length that is substantially equal to the distance between said first and second end surfaces.

13. The building system of claim 10, wherein said first recessed surface is proximate said first major surface and said second recessed surface is proximate said second major surface.

14. The building system of claim 10, wherein, for each of said planks, the second major surface has a slot oriented transversely to said second major surface and generally perpendicular to the longitudinal axis of said plank, said slot extending to said first and second side surfaces and having a depth sufficient to intersect said longitudinal grooves therein, said slot being positioned proximate one of said first and second end surfaces for abutment with an underlying member of the building system, and further including connecting means for engaging said slot and preventing longitudinal displacement thereof.

* * * * *